United States Patent [19]

Nethercot

[11] 3,990,360

[45] Nov. 9, 1976

[54] HOT PRESS PRINTING MACHINES

[75] Inventor: Arthur Owen Martin Nethercot, London, England

[73] Assignee: The Post Office, London, England

[22] Filed: Sept. 29, 1975

[21] Appl. No.: 617,581

[30] Foreign Application Priority Data

Oct. 3, 1974 United Kingdom ..... 42498/74

[52] U.S. Cl. ..... 101/27; 101/390

[51] Int. Cl.[2] ..... B41F 3/50

[58] Field of Search ..... 101/27, 28, 31, 382, 101/383, 389, 390, 394, 25

[56] References Cited

UNITED STATES PATENTS

| | | | |
|---|---|---|---|
| 1,369,909 | 3/1921 | Turner | 101/383 |
| 1,840,816 | 1/1932 | Kieper et al. | 101/383 X |
| 2,382,600 | 8/1945 | Bobst et al. | 101/390 |
| 2,615,395 | 10/1952 | Hahn, Sr. | 101/390 |
| 3,035,687 | 5/1962 | Gay | 101/383 |
| 3,141,406 | 7/1964 | Weinland | 101/390 X |
| 3,296,966 | 1/1967 | Standiford | 101/390 X |

FOREIGN PATENTS OR APPLICATIONS

| | | | |
|---|---|---|---|
| 667,604 | 7/1963 | Canada | 101/27 |
| 1,158,943 | 7/1969 | United Kingdom | 101/27 |

*Primary Examiner*—E. H. Eickholt

*Attorney, Agent, or Firm*—Hall & Houghton

[57] ABSTRACT

A platen holder for a hot press printing machine has a framework for attachment to the machine. On the framework is pivotally supported a platen receiver in which a platen holder is slidably mounted. The receiver is pivoted into an inverted position for providing easy access to a type block carried by the platen.

10 Claims, 4 Drawing Figures

HOT PRESS PRINTING MACHINES

Figure 1:
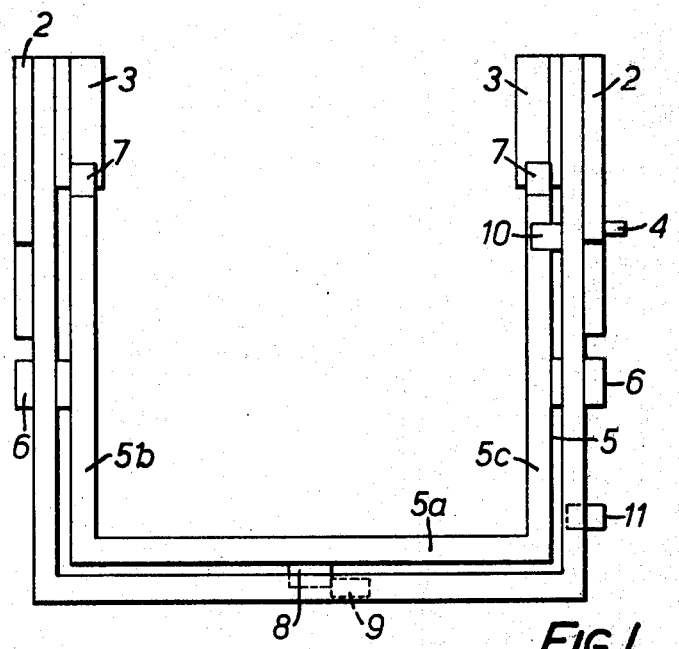

This invention relates to a hot press printing machine and in particular to a platen holder for facilitating the removal of the platen in a hot press printing machine.

In hot press printing machines the type holder or die is normally carried on the underside of a machined rectangular steel platen which has to be removed and inverted when alterations of the type pattern are required. In large machines the platen is quite a heavy item which can cause serious injury to personnel if carelessly handled. The platen is usually removed by pulling it forward. This causes it to slide forward in support channels. Handles are normally provided at the front of the platen to facilitate removal, which means that the rear of the platen cannot be supported as the platen comes forward clear of its support channels, with the result that the steel platen tends to pivot about the handles as it clears the support channels and may strike the operator on the lower part of the body in addition to causing severe strain to the arms and back.

It is an object of the present invention to provide a platen holder for a hot press printing machine for facilitating the handling of a platen.

According to the present invention a platen holder comprises a framework attachable to the hot press printing machine, platen receiving means for receiving and supporting a platen, the platen receiving means being supported by the framework and being mounted thereon in a manner permitting inversion of the platen receiving means with respect to the framework, and means for retaining the platen in the platen receiving means during inversion.

Preferably, locking means are provided for locking the platen receiving means in position when inverted. Further locking means may be provided for locking the platen receiving means in a position to receive a platen from the printing machine.

In one embodiment of the invention, the platen receiving means is pivotally mounted in the framework.

The platen receiving means may comprise two spaced channel members into which the platen slides. Retention of the platen after entry into the channel members and during inversion is effected by a third member transverse to the channel members and which may itself also be of channel shape.

The framework may provide two spaced inside members connected together at one end by a cross member but not connected together at the other end. The side members may be parallel with the two spaced channel members of the platen receiving means, those channel members being pivotally attached to the side members.

The framework may be attached to the press by means of cranked members which project from the framework and are engageable with tubular members on the press. The framework may be locked to the press for example by means of a latch which engage with a pin on the framework.

The table permits removal of the platen from the press, supporting the platen fully when the platen clears the support channels in the press, and permits inversion of the platen by rotation of the pivotally mounted platen receiving means. Part of the framework acts as an intermediate support for the platen as it is moved from the press support channels to the platen receiving means. Safety catches may be incorporated to prevent movement of the platen unless the platen receiving means is in the platen receiving position.

Figure 2:
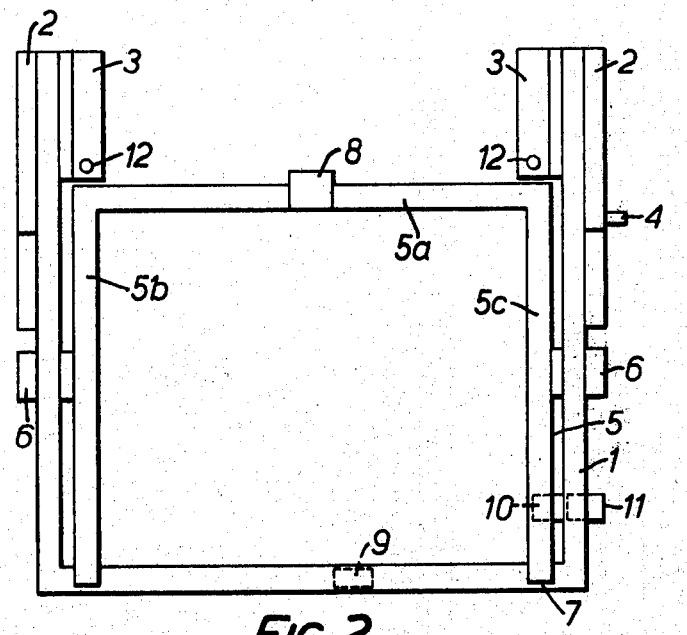
Figure 3:
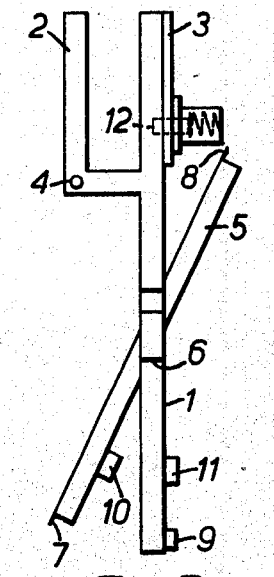
Figure 4:
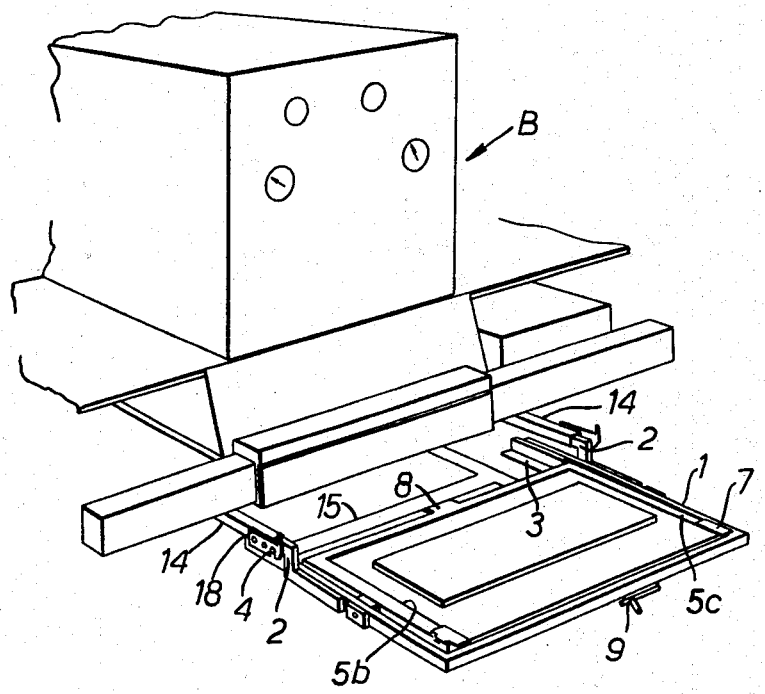

A platen holder according to the invention will now be described by way of example only and with reference to the accompanying drawings, of which:

FIG. 1 is a plan view of the holder with the rotatable framework positioned to receive the platen, FIG. 2 is a plan view of the holder with the rotatable framework rotated to invert the platen, FIG. 3 is a side view of the holder showing the rotatable framework at an intermediate position, and FIG. 4 is a perspective view of a part of a typical hot press printing machine with the platen holder in position.

Referring now to FIG. 1, the platen holder consists of a framework 1 having attached to its members 2 which slide into and are supported by tubular members on the press as will be described below. The members 2 are cranked, as shown in FIG. 3, to accommodate the offset between the positions of the tubular receiving members and the platen on the press. The framework has attached to it two L-section ledges 3 which act as intermediate supports for the platen as it travels from its supports on the press to platen receiving means comprising a second framework 5 which is pivotally attached to the framework 1 by pivots 6. The framework 1 is provided with a pin 4 which engages with a latch (not shown) on the press to prevent the platen holder moving away from the press during removal of the platen. The framework 1 can be constructed from tubular material of rectangular cross-section or it can be made of solid members. The member 2 can also be either hollow or solid.

The framework 5 is made from three U-section members *5a*, *5b*, *5c*, the open ends of the section facing inwardly to provide guide channels into which the platen is directed and which support the platen as the framework 5 is rotated within the framework 1. The framework 5 is thus open along one side. The side limbs *5b*, *5c* of the framework 5 have projections 7 at their open ends and there is a single projection 8 secured midway along the length of the side *5a*. The framework 1 is additionally provided with a bolt-action clamp shown schematically at 9 which traps the projection 8 in the position shown in FIG. 1 to prevent rotation of the framework 5 from this position which is the platen receiving position. The bolt-action clamp 9 is shown in FIGS. 1 and 3.

The framework 5 has mounted on the upper side of limb *5c* as seen in FIG. 1) (the underside in FIG. 2) a catch block 10 positioned to co-operate with a spring-loaded catch shown diagrammatically at 11 mounted on the underside of frame 1 to prevent rotation of the framework 5 from the position shown in FIG. 2 which is the inverted position. Two spring-loaded plungers 12, 12′ prevent the platen from moving out across the supports 3 unless the framework 5 is in the platen-receiving position.

In use, the framework 5 is rotated to the position shown in FIG. 1 - the platen receiving position - the lugs 7 depressing safety catches 12, 12′ and the projection 8 locks the framework 5 in this position by means of the clamp 9.

The table is then attached to the press by inserting the members 2 into the tubular members on the press and the latch is operated to trap the pin 4 to secure the table to the press. This prevents the table from moving away from the press inadvertently. A second pin 4 could also be provided on the other member 2. The platen is then pulled towards the table and moves across the supports 3 on the framework 1 and into the framework 5 which is large enough to accommodate the platen. In this position the type block is normally underneath the platen. On releasing the clamp 9 the framework 5 can be rotated about pivots 6 into the position shown in FIG. 2 – the inverted position – thereby bringing the type block to a position in which the block is uppermost, the framework 5 being retained in that position by the spring-loaded catch 11. The direction of rotation is indicated by the arrow in FIG. 3. In this position the type can be easily changed or modified. During rotation of the framework 5, the platen is cradled in the channel section side 5*c* and is thereby retained in position.

The platen is returned to the press by reversing the procedure. The platen holder may then be removed from the press if desired by unlatching the pins 4.

FIG. 4 shows in diagrammatic form only a part 13 of a hot press printing machine. On each side of the position of the platen when in the machine is a tubular socket 14 for receiving the members 2 of the framework 1. When the members 2 are located in the sockets 14, the ledges 3 are on the same level as supports 15 fitted to the machine. Thus, the platen is supported effectively as it travels from the supports 15 over the ledges 3 and into the channel shaped limbs 5*a* and 5*b* of the framework 5.

FIG. 4 shows a platen 16 at the end of its travel into the framework 5 and after the framework has been inverted. In this position the projections 7 rest on the framework 1 and the framework 5 is locked against movement by the catch block 10 and catch 11.

FIG. 4 also shows latches 18 mounted upon the sockets 14. These latches co-operate with pins 4 to hold the member 2 in th sockets and thus the platen holder in position on the machine.

In the inverted position shown in FIG. 4, the type 17 mounted upon the platen 16 is uppermost and easily accessible to an operator. The platen is fully supported and locked in the inverted position and thus the operator has both hands free to manipulate the type as required.

The platen holder therefore provides a safe and convenient means for supporting the platen to provide easy access to the type block either for changing or modifying the type block and is also a compact and easy-to-handle work table.

The platen holder can be constructed from a variety of materials. Metals, for example, steel and aluminium are suitable.

It will be appreciated that the manner of attachment of the platen holder to the press does not form part of the present invention and the platen holder may be attached to the press in ways other than that described above.

I claim:

1. A platen holder for use with a hot press printing machine comprising a framework attachable to the hot press printing machine, platen receiving means for receiving and supporting a platen, the platen receiving means being supported by the framework and mounted thereon in a manner permitting inversion of the platen holding means with respect to the framework, and means for retaining the platen in the platen receiving means during inversion.

2. A holder as claimed in claim 1 in which locking means are provided for locking the platen receiving means in position when inverted.

3. A holder as claimed in claim 1 in which further locking means are provided for locking the platen receiving means in a position to receive a platen from a hot press printing machine.

4. A holder as claimed in claim 1 in which the platen receiving means is pivotally mounted on the framework.

5. A holder as claimed in claim 1 in which the platen receiving means comprises two spaced channel members into which the platen is slidable.

6. A holder as claimed in claim 5 and including a third channel member into which the platen is slidable, the third member being secured transversely to the said two channel members in a position such that it retains the platen in position during inversion.

7. A holder as claimed in claim 6 in which the framework has two spaced side members connected together at one end by a cross member but not connected together at the other end.

8. A holder as claimed in claim 7 in which the side members and the two spaced channel members are parallel, and in which each spaced channel member is pivotally attached to one of the side members.

9. A holder as claimed in claim 1 in which the framework has extensions by which the holder is mounted upon a hot press printing machine.

10. A holder as claimed in claim 1 in which means are provided on the holder for co-operation with further means on the hot press printing machine for releasably locking the holder to the machine.

* * * * *